US011459903B1

(12) United States Patent
Kim et al.

(10) Patent No.: US 11,459,903 B1
(45) Date of Patent: Oct. 4, 2022

(54) REDIRECTING STATOR FLOW DISCOURAGER

(71) Applicant: Solar Turbines Incorporated, San Diego, CA (US)

(72) Inventors: Yong W. Kim, San Diego, CA (US); John F. Lockyer, San Diego, CA (US)

(73) Assignee: Solar Turbines Incorporated, San Diego, CA (US)

( * ) Notice: Subject to any disclaimer, the term of this patent is extended or adjusted under 35 U.S.C. 154(b) by 0 days.

(21) Appl. No.: 17/344,684

(22) Filed: Jun. 10, 2021

(51) Int. Cl.
*F01D 11/00* (2006.01)
*F01D 9/04* (2006.01)

(52) U.S. Cl.
CPC ..... *F01D 11/001* (2013.01); *F01D 9/04* (2013.01); *F05D 2220/32* (2013.01); *F05D 2240/12* (2013.01); *F05D 2240/35* (2013.01); *F05D 2240/55* (2013.01)

(58) Field of Classification Search
CPC ..... F01D 11/001; F01D 9/04; F05D 2220/32; F05D 2240/12; F05D 2240/35; F05D 2240/55
See application file for complete search history.

(56) References Cited

U.S. PATENT DOCUMENTS 5,545,004 A * 8/1996 Ho ..... F01D 5/081 415/115
7,137,777 B2 * 11/2006 Fried ..... F01D 5/082 415/121.2
7,341,429 B2 * 3/2008 Montgomery ..... F01D 5/082 415/115
7,465,152 B2 12/2008 Nigmatulin
7,578,653 B2 8/2009 Klasing et al.
9,309,783 B2 * 4/2016 Nallam ..... F01D 11/02
9,638,051 B2 5/2017 Lewis et al.
9,938,847 B2 4/2018 Li et al.
10,337,344 B2 7/2019 Granberg et al.
10,428,670 B2 * 10/2019 Rioux ..... F01D 11/001
10,641,118 B2 5/2020 Ikeda et al.
2009/0317244 A1 * 12/2009 Howe ..... F01D 11/001 415/177
2015/0040567 A1 2/2015 Lu et al.
2015/0354391 A1 * 12/2015 Li ..... F01D 11/08 415/173.1

FOREIGN PATENT DOCUMENTS

CN 105917098 B 4/2019
WO 2018203924 A1 11/2018

* cited by examiner

*Primary Examiner* — Jesse S Bogue
(74) *Attorney, Agent, or Firm* — Procopio, Cory, Hargreaves & Savitch LLP

(57) ABSTRACT

In the turbine of a gas turbine engine, disk cavities exist between stator and rotor assemblies. These disk cavities enable hot gas from the hot gas flow path to ingress between the stator and rotor assemblies with detrimental effects to the durability of the turbine. Thus, a flow discourager is disclosed that can be mounted to the stator assembly. The flow discourager comprises a continuous external surface that defines a recirculation zone within the disk cavities to circulate the hot gas back out into the hot gas flow path.

19 Claims, 4 Drawing Sheets

REDIRECTING STATOR FLOW DISCOURAGER

TECHNICAL FIELD

The embodiments described herein are generally directed to turbomachinery, and, more particularly, to a stator-side flow discourager that redirects hot gas ingress within a disk cavity between a stator assembly and rotor assembly.

BACKGROUND

In the turbine of a gas turbine engine, adjacent stator and rotor assemblies cannot abut each other, since the rotor assembly must be free to rotate. Thus, disk cavities exist between the stator and rotor assemblies. Hot gas flowing through the turbine enters these disk cavities due to the uneven pressure field generated by the interaction between stator and rotor blades. This ingress of hot gas into the disk cavities is detrimental to the durability of the turbine.

Flow discouragers can be employed to reduce the level of hot gas ingress and lower metal temperatures within the disk cavities. For example, U.S. Pat. No. 5,545,004 discloses a contoured shroud that is mounted to a stator assembly and has a free edge that closely underlies the upstream edge of a blade platform of the rotor assembly. The contoured shroud defines a recirculation pocket to prevent hot gas ingestion from the outer hot gas flow path into an internal cooled cavity.

The present disclosure is directed toward overcoming one or more problems, in the state of the art, discovered by the inventors.

SUMMARY

A flow discourager for a turbine is disclosed. In an embodiment, the flow discourager comprises: a body configured to mate with a stator assembly at a position that is radially inward from a stator platform of the stator assembly; and a hook portion that extends downstream from the body and hooks back towards the body, wherein the hook portion comprises a continuous external surface that defines a recirculation zone radially inward from the stator platform when the body is mated with the stator assembly.

BRIEF DESCRIPTION OF THE DRAWINGS

The details of embodiments of the present disclosure, both as to their structure and operation, may be gleaned in part by study of the accompanying drawings, in which like reference numerals refer to like parts, and in which.

DETAILED DESCRIPTION

The detailed description set forth below, in connection with the accompanying drawings, is intended as a description of various embodiments, and is not intended to represent the only embodiments in which the disclosure may be practiced. The detailed description includes specific details for the purpose of providing a thorough understanding of the embodiments. However, it will be apparent to those skilled in the art that embodiments of the invention can be practiced without these specific details. In some instances, well-known structures and components are shown in simplified form for brevity of description.

For clarity and ease of explanation, some surfaces and details may be omitted in the present description and figures. In addition, references herein to "upstream" and "downstream" or "forward" and "aft" are relative to the flow direction of the primary gas (e.g., air) used in the combustion process, unless specified otherwise. It should be understood that "upstream," "forward," and "leading" refer to a position that is closer to the source of the primary gas or a direction towards the source of the primary gas, and "downstream," "aft," and "trailing" refer to a position that is farther from the source of the primary gas or a direction that is away from the source of the primary gas. Thus, a trailing edge or end of a component (e.g., a turbine blade) is downstream from a leading edge or end of the same component. Also, it should be understood that, as used herein, the terms "side," "top," "bottom," "front," "rear," "above," "below," and the like are used for convenience of understanding to convey the relative positions of various components with respect to each other, and do not imply any specific orientation of those components in absolute terms (e.g., with respect to the external environment or the ground).

Figure 1:
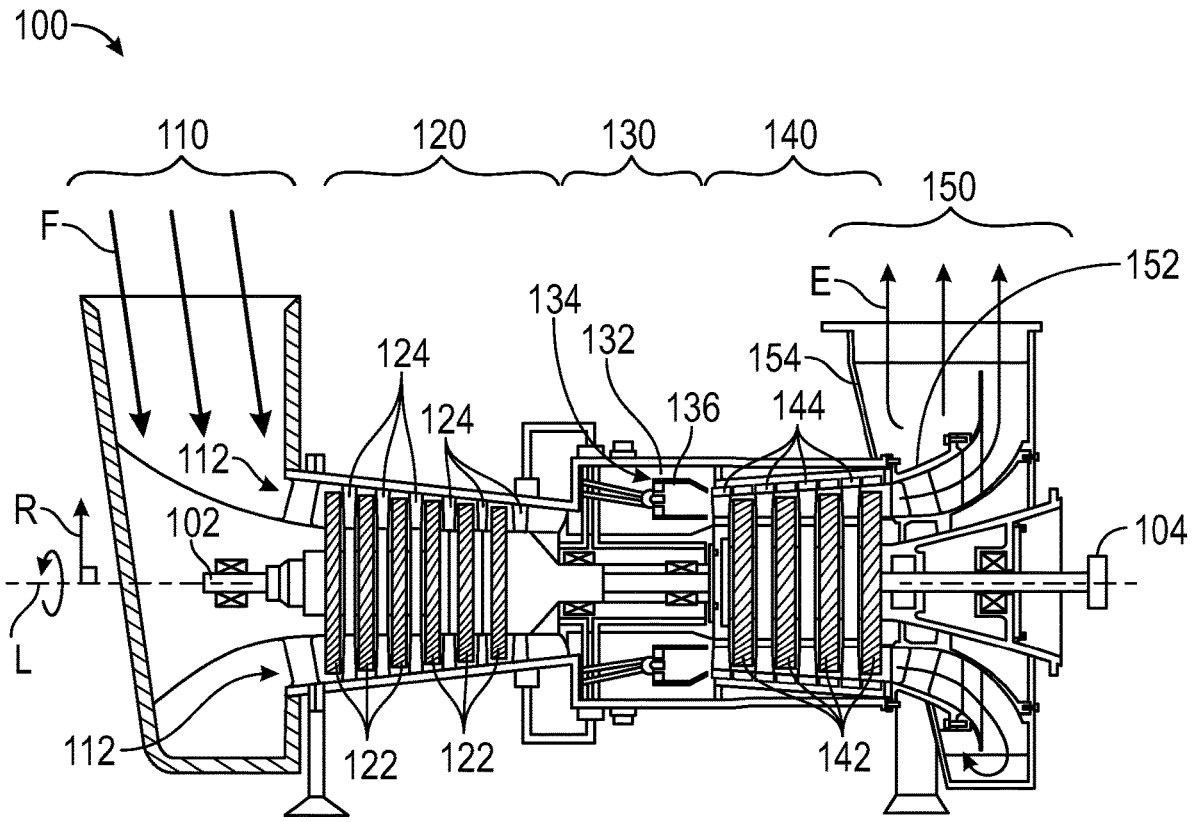
FIG. 1 illustrates a schematic diagram of a gas turbine engine, according to an embodiment.

FIG. 1 illustrates a schematic diagram of a gas turbine engine 100, according to an embodiment. Gas turbine engine 100 comprises a shaft 102 with a central longitudinal axis L. A number of other components of gas turbine engine 100 are concentric with longitudinal axis L and may be annular to longitudinal axis L. A radial axis may refer to any axis or direction that radiates outward from longitudinal axis L at a substantially orthogonal angle to longitudinal axis L, such as radial axis R in FIG. 1. Thus, the term "radially outward" should be understood to mean farther from or away from longitudinal axis L, whereas the term "radially inward" should be understood to mean closer or towards longitudinal axis L. As used herein, the term "axial" will refer to any axis or direction that is substantially parallel to longitudinal axis L.

In an embodiment, gas turbine engine 100 comprises, from an upstream end to a downstream end, an inlet 110, a compressor 120, a combustor 130, a turbine 140, and an exhaust outlet 150. In addition, the downstream end of gas turbine engine 100 may comprise a power output coupling 104. One or more, including potentially all, of these components of gas turbine engine 100 may be made from stainless steel and/or durable, high-temperature materials known as "superalloys." A superalloy is an alloy that exhibits excellent mechanical strength and creep resistance at high temperatures, good surface stability, and corrosion and oxidation resistance. Examples of superalloys include, without limitation, Hastelloy, Inconel, Waspaloy, Rene alloys, Haynes alloys, Incoloy, MP98T, TMS alloys, and CMSX single crystal alloys.

Inlet 110 may funnel a working fluid F (e.g., the primary gas, such as air) into an annular flow path 112 around longitudinal axis L. Working fluid F flows through inlet 110 into compressor 120. While working fluid F is illustrated as flowing into inlet 110 from a particular direction and at an angle that is substantially orthogonal to longitudinal axis L, it should be understood that inlet 110 may be configured to receive working fluid F from any direction and at any angle that is appropriate for the particular application of gas turbine engine 100. While working fluid F will primarily be described herein as air, it should be understood that working fluid F could comprise other fluids, including other gases.

Compressor 120 may comprise a series of compressor rotor assemblies 122 and stator assemblies 124. Each compressor rotor assembly 122 may comprise a rotor disk that is circumferentially populated with a plurality of rotor blades. The rotor blades in a rotor disk are separated, along the axial axis, from the rotor blades in an adjacent disk by a stator assembly 124. Compressor 120 compresses working fluid F through a series of stages corresponding to each compressor rotor assembly 122. The compressed working fluid F then flows from compressor 120 into combustor 130.

Combustor 130 may comprise a combustor case 132 that houses one or more, and generally a plurality of, fuel injectors 134. In an embodiment with a plurality of fuel injectors 134, fuel injectors 134 may be arranged circumferentially around longitudinal axis L within combustor case 132 at equidistant intervals. Combustor case 132 diffuses working fluid F, and fuel injector(s) 134 inject fuel into working fluid F. This injected fuel is ignited to produce a combustion reaction in one or more combustion chambers 136. The combusting fuel-gas mixture drives turbine 140.

Turbine 140 may comprise one or more turbine rotor assemblies 142 and stator assemblies 144 (e.g., nozzles). Each turbine rotor assembly 142 may correspond to one of a plurality or series of stages. Turbine 140 extracts energy from the combusting fuel-gas mixture as it passes through each stage. The energy extracted by turbine 140 may be transferred (e.g., to an external system) via power output coupling 104.

The exhaust E from turbine 140 may flow into exhaust outlet 150. Exhaust outlet 150 may comprise an exhaust diffuser 152, which diffuses exhaust E, and an exhaust collector 154 which collects, redirects, and outputs exhaust E. It should be understood that exhaust E, output by exhaust collector 154, may be further processed, for example, to reduce harmful emissions, recover heat, and/or the like. In addition, while exhaust E is illustrated as flowing out of exhaust outlet 150 in a specific direction and at an angle that is substantially orthogonal to longitudinal axis L, it should be understood that exhaust outlet 150 may be configured to output exhaust E towards any direction and at any angle that is appropriate for the particular application of gas turbine engine 100.

Figure 2:
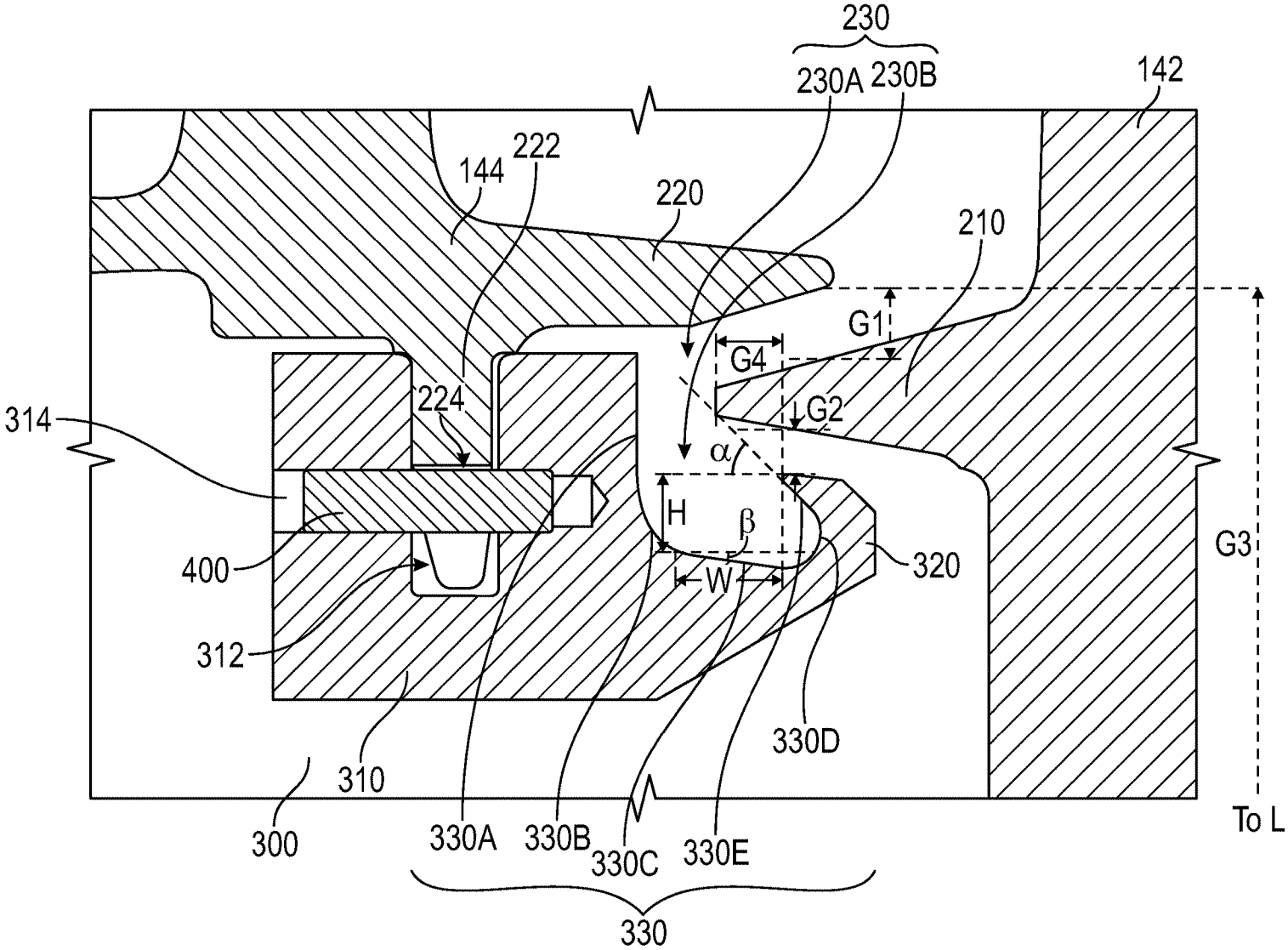
FIG. 2 illustrates a cross-sectional view of an example interface between a stator assembly and a rotor assembly with an installed flow discourager, according to an embodiment.

FIG. 2 illustrates a cross-sectional view of an example interface between a stator assembly 144 and a rotor assembly 142 with an installed flow discourager 300, according to an embodiment. It should be understood that the illustrated cross-sectional view is a region of a plane that contains longitudinal axis L. The top of FIG. 2 is radially outward from the bottom of FIG. 2, and the left side of FIG. 2 is upstream from the right side of FIG. 2.

Rotor assembly 142 comprises a rotor platform 210 that extends annularly around shaft 102, and stator assembly 144 comprises a stator platform 220 that extends annularly around shaft 102. both rotor platform 210 and stator platform 220 support a plurality of airfoils extending radially outward. Since rotor assembly 142 must be able to rotate around shaft 102 while stator assembly 144 remains stationary, rotor platform 210 cannot abut stator platform 220. Thus, a narrow disk cavity 230 exists between rotor platform 210 and stator platform 220.

Disk cavity 230 is subject to detrimental hot gas ingress as a result of the uneven pressure field generated by the interaction between rotor assembly 142 and stator assembly 144. It should be understood that the hot gas, in this case, is the combusting fuel-gas mixture that flows over the radially outward surfaces of rotor platform 210 and stator platform 220 as the mixture passes through the stages of turbine 140. As the combusting fuel-gas mixture passes over stator platform 220 to rotor assembly 142, some of the hot gas is ingested into disk cavity 230 due to the uneven pressure field in this region. Without a flow discourager, the temperature within disk cavity 230 can, for example, exceed 1,250 degrees Fahrenheit.

In an embodiment, flow discourager 300 is mounted to a downstream portion of stator assembly 144 at the interface between the stator assembly 144 and a rotor assembly 142 that is immediately downstream from the stator assembly 144. For example, platform 220 of stator assembly 144 may comprise a flange 222 that extends radially inward from the radially inward facing surface of platform 220 and comprises an aperture 224 extending axially through flange 222. A body 310 of flow discourager 300 may comprise a corresponding recess 312 that is configured in size and shape to receive or mate with flange 222. Body 310 of flow discourager 300 may also comprise an aperture 314 extending axially through an upstream surface of body 310 through recess 312 and partially through a downstream portion of body 310. A pin 400 may be inserted into aperture 314, so that it extends through aperture 224 in flange 222, and thereby prevents flow discourager 300 from rotating relative to stator assembly 144. In an alternative embodiment, flow discourager 300 may be mounted to platform 220 of stator assembly 144 by another mechanism, including with a flange 222 or without a flange 222 (e.g., fastened directly to a radially inward facing surface of platform 220), and using any known fastening means (e.g., screws, rivets, nuts and bolts, etc.).

It should be understood that stator platform 220, including flange 222, and flow discourager 300 may form continuous annuli around longitudinal axis L. Similarly, rotor platform 210 may form a continuous annulus around longitudinal axis L. In other words, in reality, the cross-section illustrated in FIG. 2 is rotated around longitudinal axis L to form a complete ring. Accordingly, flow discourager 300 may comprise a plurality of apertures 314 and pins 400, and flange 222 may comprise a plurality of apertures 224. Flow discourager 300 can be, but does need to be, formed as a single piece of material. For example, flow discourager 300 could be formed as two semi-circular pieces that are joined together into a complete annulus, four quadrants of a circle that are joined together into a complete annulus, and the like. The same can be said for other components, such as rotor assembly 142 and stator assembly 144.

In an embodiment, flow discourager 300 comprises a hook portion 320 that extends downstream from body 310. Hook comprises an external surface 330 that defines a recirculation region or zone 230B within disk cavity 230. As illustrated, external surface 330 may have a hook-shaped cross-section that is configured to guide hot gas ingress radially outward towards stator platform 220 and back out through narrow gap 230A between stator platform 220 and rotor platform 210. In the illustrated embodiment, external surface 330 comprises a substantially radially extending region 330A, a first curved region 330B, a substantially axially extending region 330C, a second curved region 330D, and an upstream extending region 330E. In this embodiment, the cross-sectional profile of the bottom portion of external surface 330 resembles a race-track, and may be referred to as a race-track hook.

FIG. 2 illustrates dimensions G1, G2, G3, G4, W, and H, and angles α and β. G1 is the distance between the radially inward facing surface of the downstream end of stator platform 220 and the radially outward facing surface of the upstream end of rotor platform 210. In other words, G1 is the height of gap 230A. G2 is the distance between the radially outward facing surface of hook portion 320 and the radially inward facing surface of rotor platform 210. A distance, along the radial axis, between a radially inward facing surface of the downstream portion of the stator platform and a radially outward facing surface of the upstream portion of the rotor platform is less than or equal to a distance, along the radial axis, between a radially outward facing surface of the hook portion and a radially inward facing surface of the upstream portion of the rotor platform. G3 is the distance between the radially inward facing surface of the downstream edge of platform 220 and longitudinal axis L (i.e., the center line of gas turbine engine 100). G4 is the distance between the upstream facing surface of platform 210 and the upstream end of hook portion 320 (i.e., the upstream edge of upstream extending region 330E). W is the axial width of substantially axially extending region 330C (i.e., the distance between the ends of substantially axially extending region 330C along an axis that is parallel to longitudinal axis L), and H is the radial height of first curved region 330B (i.e., the distance between the ends of first curved region 330B along a radial axis). Angle α is the angle of upstream extending region 330E with respect to longitudinal axis L (or an axial axis that is parallel to longitudinal axis L), and angle β is the angle of substantially axially extending region 330C with respect to longitudinal axis L (or the axial axis). In an embodiment, the ratio of G1 to G3 (i.e., G1/G3) is in the range of 0.005 to 0.02, the ratio of G2 to G3 (i.e., G2/G3) is in the range of 0.005 to 0.02, and the ratio of G4 to G3 (i.e., G4/G3) is in the range of −0.01 to 0.02. In addition, angle α may be in the range of 0 degrees to 90 degrees, and angle β may be in the range of −30 degrees to 30 degrees. The ratio of W to H (i.e., W/H) may be in the range of 0.0 to 4.0. In addition, in an embodiment, the radius of curvature of first curved region 330B is greater than or equal to the radius of curvature of second curved region 330D. The radius of curvatures of first curved region 330B and second curved region 330D may be as large as possible within manufacturing and design constraints. External surface 330 may be blended with the contour of stator platform 220, such that the two surfaces collectively form a nearly continuous surface for the recirculation zone.

During operation, hot gas will enter disk cavity 230 via gap 230A between stator platform 220 and rotor platform 210, and external surface 330 will guide the hot gas around recirculation zone 230B and back out through gap 230A. In particular, radial region 330A will guide the flow of the hot gas radially inward, first curved region 330B will transition the hot gas flow to move axially downstream along axial region 330C, second curved region 330D will transition the hot gas flow to move radially outward, and upstream extending region 330E curves back towards radial region 330A to transition the hot gas flow to move axially upstream and radially outward and out of gap 230A.

Figure 3:
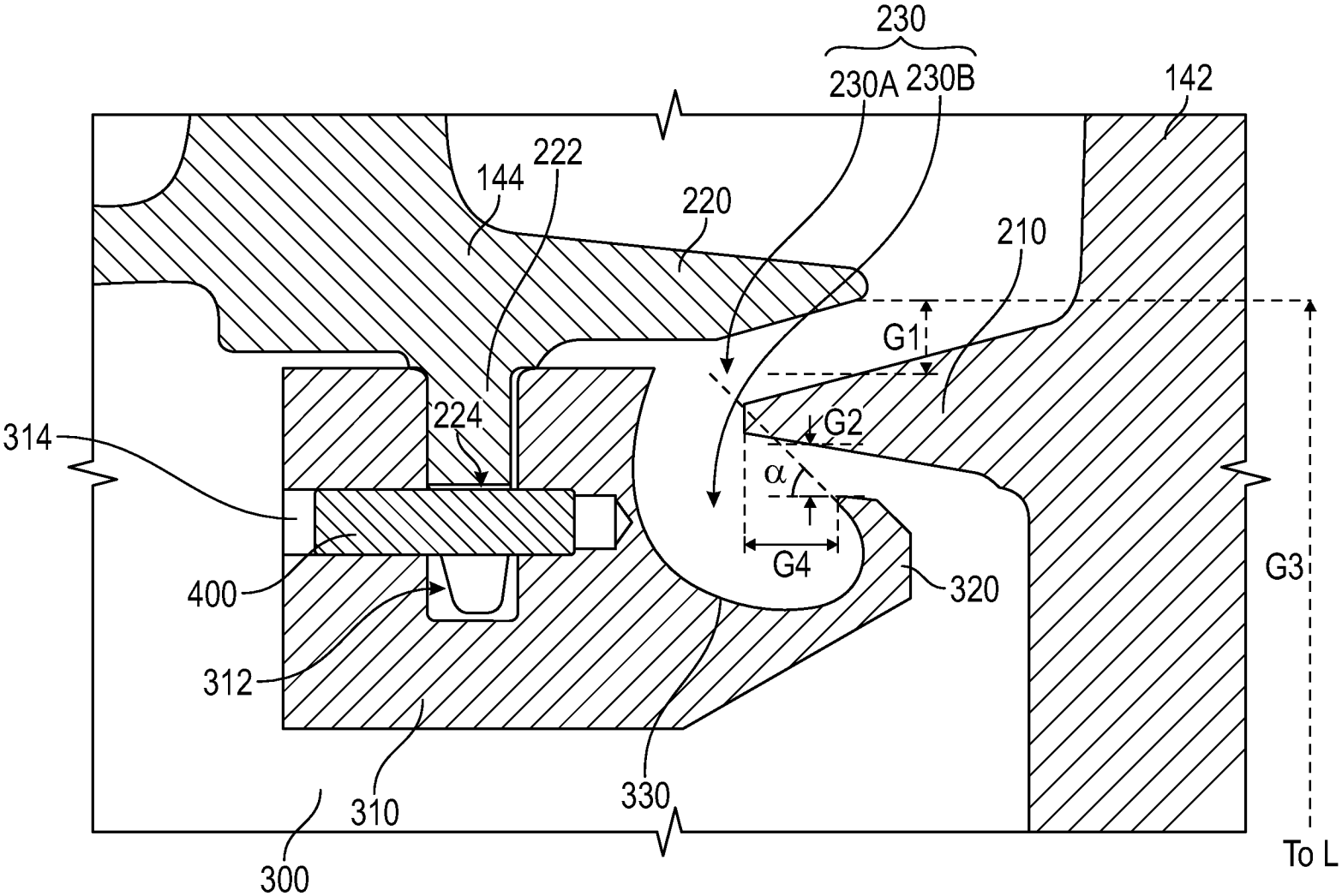
FIG. 3 illustrates a cross-sectional view of an example interface between a stator assembly and a rotor assembly with an installed flow discourager, according to an alternative embodiment.

FIG. 3 illustrates a cross-sectional view of an example interface between a stator assembly 144 and a rotor assembly 142 with an installed flow discourager 300, according to an alternative embodiment. The embodiment in FIG. 3 differs from the embodiment in FIG. 2 only in the cross-sectional profile of external surface 330. In all other respects, the two embodiments may be identical. Thus, with the exception of external surface 330, the description of other components with respect to FIG. 2 applies equally to the components illustrated in FIG. 3. As in the embodiment with the race-track hook, the ratio of G1 to G3 (i.e., G1/G3) may be in the range of 0.005 to 0.02, the ratio of G2 to G3 (i.e., G2/G3) may be in the range of 0.005 to 0.02, the ratio of G4 to G3 (i.e., G4/G3) may be in the range of −0.01 to 0.02, and angle α may be in the range of 0 degrees to 90 degrees.

In the embodiment illustrated in FIG. 3, the cross-sectional profile of external surface 330 has a more elliptical shape than the cross-sectional profile illustrated in FIG. 2. In particular, the cross-sectional profile may correspond to a segment of the golden spiral or of the Fibonacci spiral, which is an approximation of the golden spiral. The golden spiral is a logarithmic spiral whose growth factor is the golden ratio φ:

$$\varphi = \frac{1+\sqrt{5}}{2} = 1.618033$$

The Fibonacci spiral is an approximation of the golden spiral, which starts with a rectangle partitioned into two squares. In each step, a square, whose side is equal to the length of the rectangle's longest side, is added to the rectangle.

Figure 4:
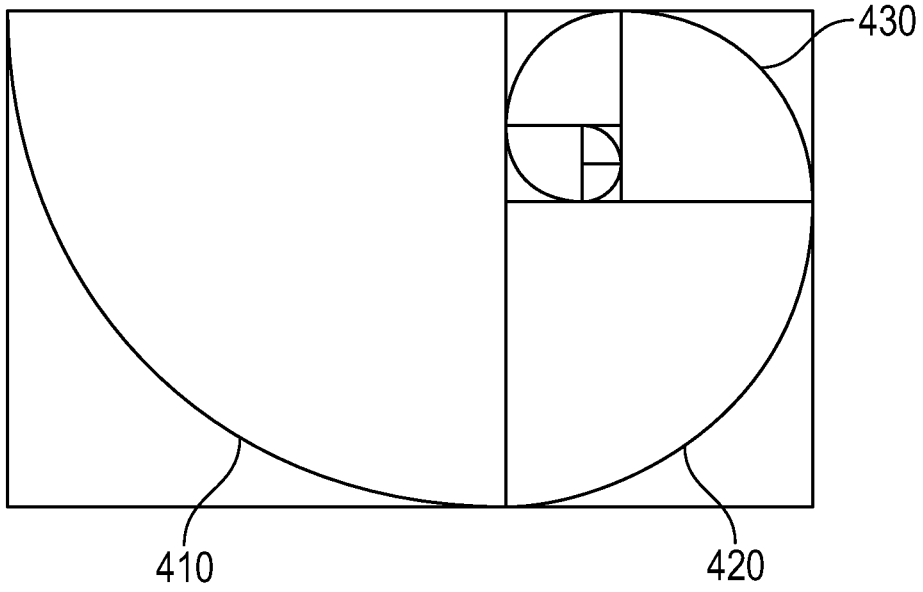
FIG. 4 illustrates a segment of the Fibonacci spiral which can be used in the design of a flow discourager, according to an embodiment.

FIG. 4 illustrates a segment of the Fibonacci spiral that can be used as the cross-sectional profile of the bottom portion of external surface 330, which may be referred to as a volute hook. In particular, the cross-sectional profile of external surface 330 may comprise or approximate a segment of the golden spiral or Fibonacci spiral that consists of segment 410 in the first section, segment 420 in the second section, and segment 430 in the third section. Segments 410 and 430 may be shortened or lengthened as needed to fit the exact dimensions of disk cavity 230. In addition, any of the segments 410-430 may be otherwise modified as needed to fit the dimensions of disk cavity 230. Thus, it should be understood that, in practice, the exact cross-sectional profile of external surface 330 may be an approximation of a segment of the golden spiral or Fibonacci spiral, rather than an exact replication of a segment of the golden spiral or Fibonacci spiral.

It should be understood that the cross-sectional profile of external surface 330 may have other shapes than those specifically illustrated herein. For example, the cross-sectional profile of external surface 330 may comprise a segment of an ellipse or circle or consist of a segment of an ellipse or circle. In addition, it should be understood that the specific embodiments illustrated in the figures are not necessarily drawn to scale, and that the relative dimensions and distances may vary depending on the particular implementation.

As illustrated, in embodiments of both the race-track hook (FIG. 2) and the volute hook (FIG. 3), the upstream end of platform 210 may extend farther upstream than the end of hook portion 320 that hooks back towards body 310. For example, upstream extending region 330E may extend less upstream than the upstream edge of platform 210. In other words, the end of hook portion 320 does not extend farther upstream than the upstream end of platform 210. Alternatively, the end of hook portion 320 may extend farther upstream than the upstream end of platform 210 or may be flush with the upstream end of platform 210 along a radial axis R.

INDUSTRIAL APPLICABILITY

The disclosed flow discourager 300 can be installed between one or more pairs of a stator assembly 144 and a rotor assembly 142 in a turbine 140 of a gas turbine engine 100. Because the rotor assembly 142 must be free to rotate, the stator assembly 144 cannot abut the rotor assembly 142. Thus, a disk cavity 230 is formed between stator assembly 144 and rotor assembly 142. Flow discourager 300 creates a recirculation zone within disk cavity 230 to efficiently circulate hot gas entering disk cavity 230 back out into the hot gas flow path. This prevents hot gas from intruding further radially inward where it may have detrimental effects on the durability of turbine 140. In an embodiment, flow discourager 300 may be installed on every stator assembly 144 in turbine 140 or on any subset of one or a plurality of stator assemblies 144 in turbine 140.

It will be understood that the benefits and advantages described above may relate to one embodiment or may relate to several embodiments. Aspects described in connection with one embodiment are intended to be able to be used with the other embodiments. Any explanation in connection with one embodiment applies to similar features of the other embodiments, and elements of multiple embodiments can be combined to form other embodiments. The embodiments are not limited to those that solve any or all of the stated problems or those that have any or all of the stated benefits and advantages.

The preceding detailed description is merely exemplary in nature and is not intended to limit the invention or the application and uses of the invention. The described embodiments are not limited to usage in conjunction with a particular type of turbomachine. Hence, although the present embodiments are, for convenience of explanation, depicted and described as being implemented in a gas turbine engine, it will be appreciated that it can be implemented in various other types of turbomachines and machines with turbines, and in various other systems and environments. Furthermore, there is no intention to be bound by any theory presented in any preceding section. It is also understood that the illustrations may include exaggerated dimensions and graphical representation to better illustrate the referenced items shown, and are not considered limiting unless expressly stated as such.

What is claimed is:

1. A flow discourager for a turbine, the discourager comprising:

a body configured to mate with a stator assembly at a position that is radially inward from a stator platform of the stator assembly; and a hook portion that extends downstream from the body and hooks back towards the body, wherein the hook portion comprises an external surface that defines a recirculation zone radially inward from the stator platform when the body is mated with the stator assembly, and wherein in a cross-sectional view, when the body is mated with the stator assembly, a profile of the continuous external surface comprises a radial region that extends radially to a first curved region, the first curved region transitions the radial region to an axial region, the axial region extends axially to a second curved region, the second curved region transitions the axial region to a radially outward direction, an upstream extending region extends back towards the radial region from the second curved region, and a radius of curvature of the first curved region is greater than a radius of curvature of the second curved region.

2. The flow discourager of claim 1, wherein, in a cross-sectional view, a profile of a portion of the continuous external surface corresponds to a segment of a golden spiral.

3. The flow discourager of claim 1, wherein, in a cross-sectional view, a profile of a portion of the continuous external surface corresponds to a segment of a Fibonacci spiral.

4. The flow discourager of claim 1, wherein the turbine has a longitudinal axis and the axial region is angled with respect to the longitudinal axis in a range of −30 degrees to 30 degrees.

5. The flow discourager of claim 1, wherein a ratio of an axial width of the axial region to a radial height of the first curved region is in a range of 0.0 to 4.0.

6. The flow discourager of claim 1, wherein the turbine has a longitudinal axis and the upstream extending region is angled with respect to the longitudinal axis in a range of 0 degrees to 90 degrees.

7. The flow discourager of claim 1, wherein in a cross-sectional view, a portion of a profile of the continuous external surface comprises a segment of an ellipse.

8. The flow discourager of claim 1, wherein, in a cross-sectional view, a portion of a profile of the continuous external surface comprises a segment of a circle.

9. The flow discourager of claim 1, wherein the flow discourager is annular.

10. A stator assembly for a turbine, the stator assembly comprising:

a stator platform supporting a plurality of airfoils; and the flow discourager of claim 1, wherein the body of the flow discourager is mated to the stator assembly at the position that is radially inward from the stator platform.

11. A turbine comprising at least one stage that comprises:

the stator assembly of claim 10; and a rotor assembly downstream from the stator assembly.

12. The turbine of claim 11, wherein the rotor assembly comprises a rotor platform, and wherein an upstream portion of the rotor platform is radially inward from a downstream portion of the stator platform and overlaps the downstream portion of the stator platform along a radial axis that is perpendicular to a longitudinal axis of the turbine.

13. The turbine of claim 12, wherein the upstream portion of the rotor platform is radially outward from the hook portion of the flow discourager and overlaps the hook portion along the radial axis.

14. The turbine of claim 13, wherein an end of the hook portion that hooks back towards the body extends at least as far upstream as the upstream portion of the rotor platform.

15. The turbine of claim 13, wherein the upstream portion of the rotor platform extends farther upstream than an end of the hook portion that hooks back towards the body.

16. The turbine of claim 13, wherein a distance, along the radial axis, between a radially inward facing surface of the downstream portion of the stator platform and a radially outward facing surface of the upstream portion of the rotor platform is less than or equal to a distance, along the radial axis, between a radially outward facing surface of the hook portion and a radially inward facing surface of the upstream portion of the rotor platform.

17. The turbine of claim 12, wherein a ratio of a distance, along the radial axis, between a radially inward facing surface of the downstream portion of the stator platform and a radially outward facing surface of the upstream portion of the rotor platform to a distance, along the radial axis, between the radially inward facing surface of the downstream portion of the stator platform and the longitudinal axis of the turbine is between 0.005 and 0.02.

18. The turbine of claim 11, further comprising a plurality of the stage.

19. A gas turbine engine comprising:

a compressor configured to compress working fluid;

a combustor downstream from the compressor and comprising one or more fuel injectors configured to inject fuel into the working fluid and produce a combustion reaction; and the turbine of claim 11 downstream from the combustor.

* * * * *